US007965243B2

(12) United States Patent
Chen et al.

(10) Patent No.: US 7,965,243 B2
(45) Date of Patent: Jun. 21, 2011

(54) ANTENNA ASSEMBLY HAVING SUBSTRATE USED FOR HOLDING RADIATING ELEMENT THEREON

(75) Inventors: Dao-Yuan Chen, Kunshan (CN); Jian-Chang Zheng, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 427 days.

(21) Appl. No.: 12/080,465

(22) Filed: Apr. 3, 2008

(65) Prior Publication Data

US 2008/0246686 A1 Oct. 9, 2008

(30) Foreign Application Priority Data

Apr. 4, 2007 (CN) ..... 2007 2 0036364

(51) Int. Cl.
*H01Q 1/24* (2006.01)

(52) U.S. Cl. ..... 343/702; 343/846; 343/878

(58) Field of Classification Search ..... 343/700, 343/702, 829, 846, 878
See application file for complete search history.

(56) References Cited

U.S. PATENT DOCUMENTS

| | | | | |
|---|---|---|---|---|
| 6,903,695 | B2 | 6/2005 | Sjoblom et al. | |
| 7,084,814 | B2 | 8/2006 | Chen | |
| 7,292,194 | B2 * | 11/2007 | Tai et al. | 343/702 |
| 7,362,277 | B2 * | 4/2008 | Su | 343/702 |
| 7,705,790 | B2 * | 4/2010 | Booth et al. | 343/702 |
| 2003/0124985 | A1 * | 7/2003 | Shin et al. | 455/82 |
| 2008/0007461 | A1 * | 1/2008 | Su et al. | 343/700 MS |
| 2008/0180330 | A1 * | 7/2008 | Wei-Shan et al. | 343/700 MS |

* cited by examiner

*Primary Examiner* — Tho G Phan
(74) *Attorney, Agent, or Firm* — Wei Te Chung; Andrew C. Cheng; Ming Chieh Chang

(57) ABSTRACT

An antenna assembly includes a base (3) and an antenna (2) disposed on the base. The antenna includes a radiating element (21) with top and bottom surfaces thereof, and the bottom surface of the radiating element abuts against and is surface mounted on the base. An arm (311) is located above the top surface of the radiating element so as to prevent the radiating element from tilting upwards excessively, and most of the radiating element is exposed outside the arm.

18 Claims, 8 Drawing Sheets

ANTENNA ASSEMBLY HAVING SUBSTRATE USED FOR HOLDING RADIATING ELEMENT THEREON

BACKGROUND OF THE INVENTION

1. Field of the Invention

The present invention relates generally to an antenna assembly, and more particularly to an antenna assembly having a substrate used for holding a radiating element thereon.

2. Description of the Prior Art

Since the wireless communication technology of using electromagnetic wave to transmit signals has the effect of remote device transmission without cable connection, and further has the mobility advantage, therefore the technology is widely applied to various products, such as moveable phones, notebook computers, intellectual home appliance with wireless communication features. Because these devices use electromagnetic wave to transmit signals, the antenna used to receive electromagnetic wave also becomes a necessity in the application of the wireless communication technology. For an inside antenna, the size of the antenna is the smaller the better. Thus, the small antenna needs a supporting element to present the shape of the small antenna from being changed. U.S. Pat. No. 6,903,695 discloses an antenna device which is intended for mounting in a casing for an apparatus. As showed in FIG. 1 of this patent, the antenna device includes a radiating element 4 manufactured from a conducting and resilient material, such as metal. A portion of the radiating element 4 is surrounded by a piece of a configurationally stable, non-conducting material, such as plastic 5. The plastic piece 5 is disposed for mounting of the antenna in the inside of the casing, preferably by snap action. However, the plastic piece 5 completely surrounding the radiating element should influence the radiating effect.

Hence, an improved antenna assembly with a moveable antenna is desired to overcome the above-mentioned shortcomings of the existing antennas.

BRIEF SUMMARY OF THE INVENTION

A primary object, therefore, of the present invention is to provide an antenna assembly which is able to fasten a small antenna in the electric device and make the antenna radiating well.

In order to implement the above object and overcomes the above-identified deficiencies in the prior art, the antenna assembly comprises a base and an antenna disposed on the base. The antenna comprises a radiating element with top and bottom surfaces thereof, and the bottom surface of the radiating element abuts against and is surface mounted on the base. An arm is located above the top surface of the radiating element so as to prevent the radiating element from tilting upwards excessively, and most of the radiating element is exposed outside the arm.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
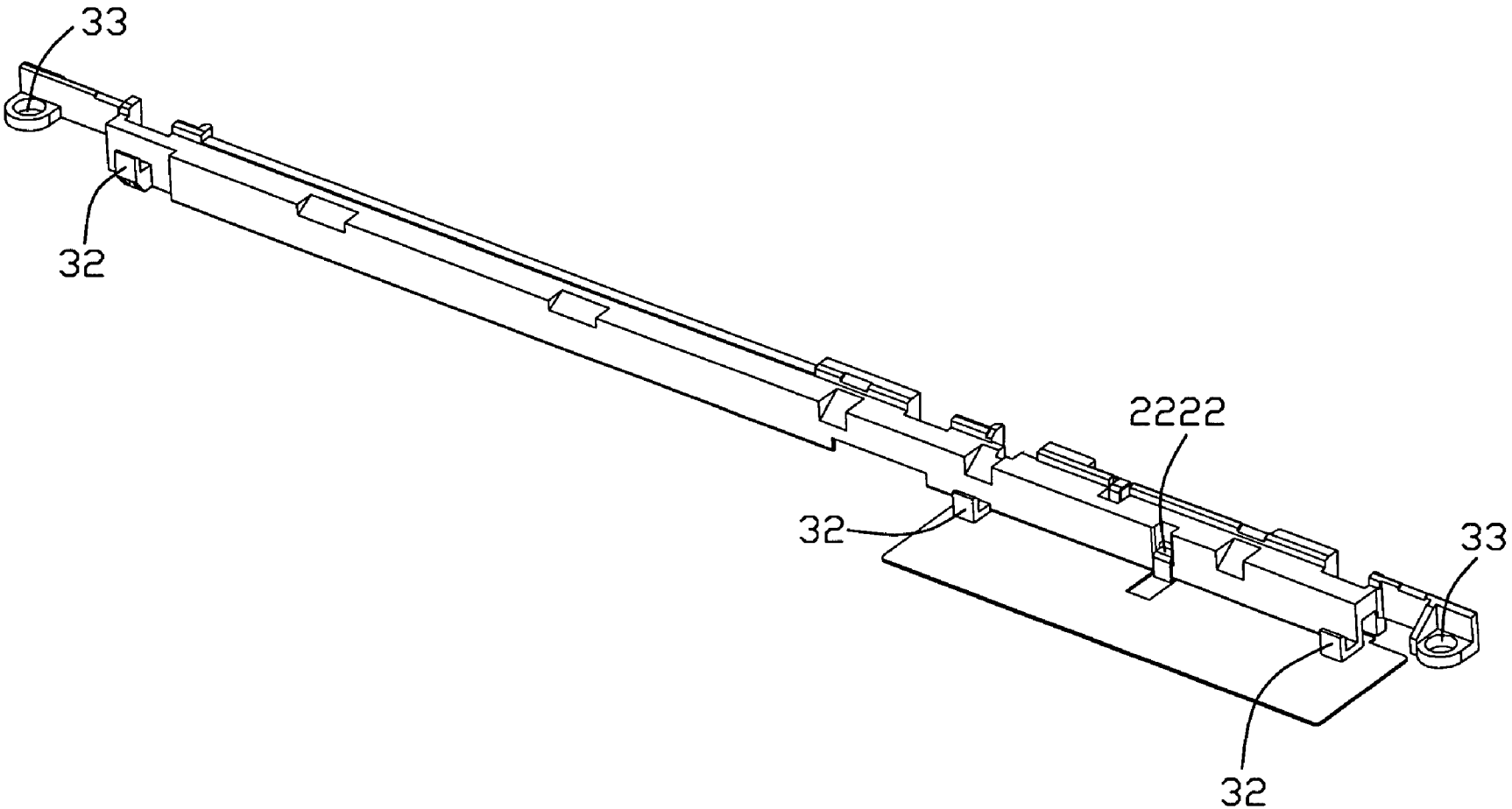
FIG. 1 is an assembled view of an antenna assembly according to the present invention.
Figure 2:
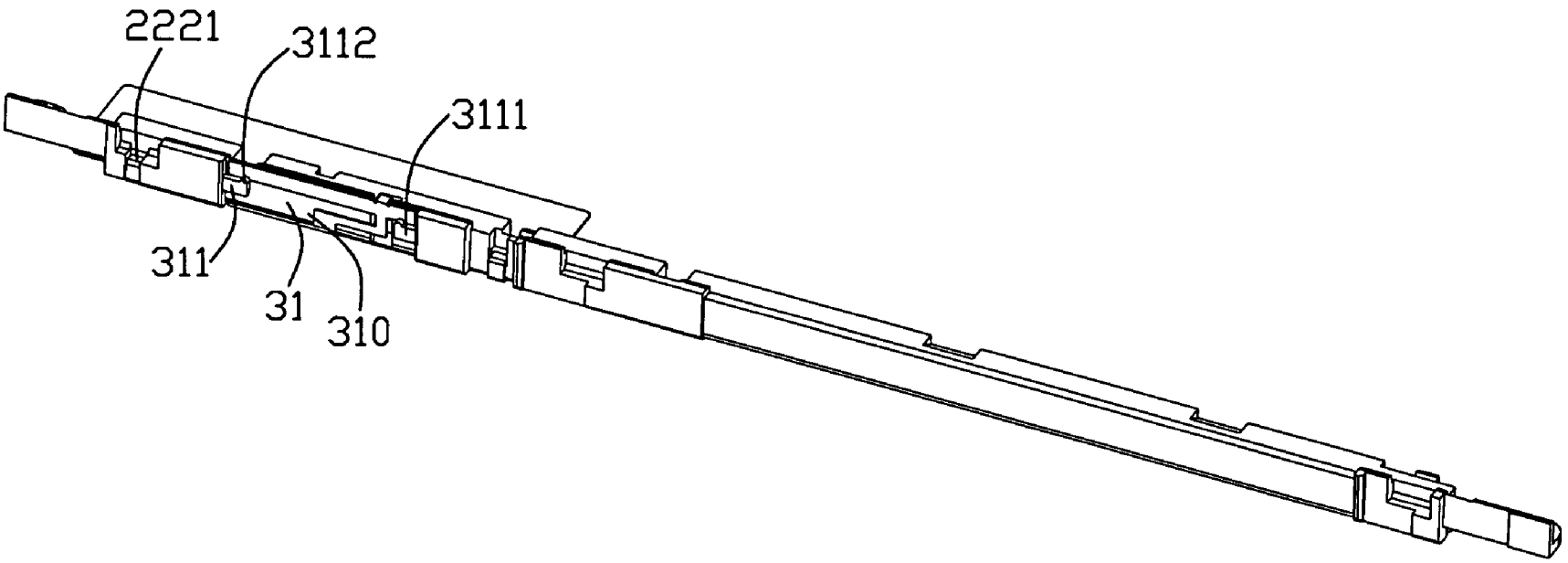
FIG. 2 is a view similar to FIG. 1, but viewed from another aspect.
Figure 3:
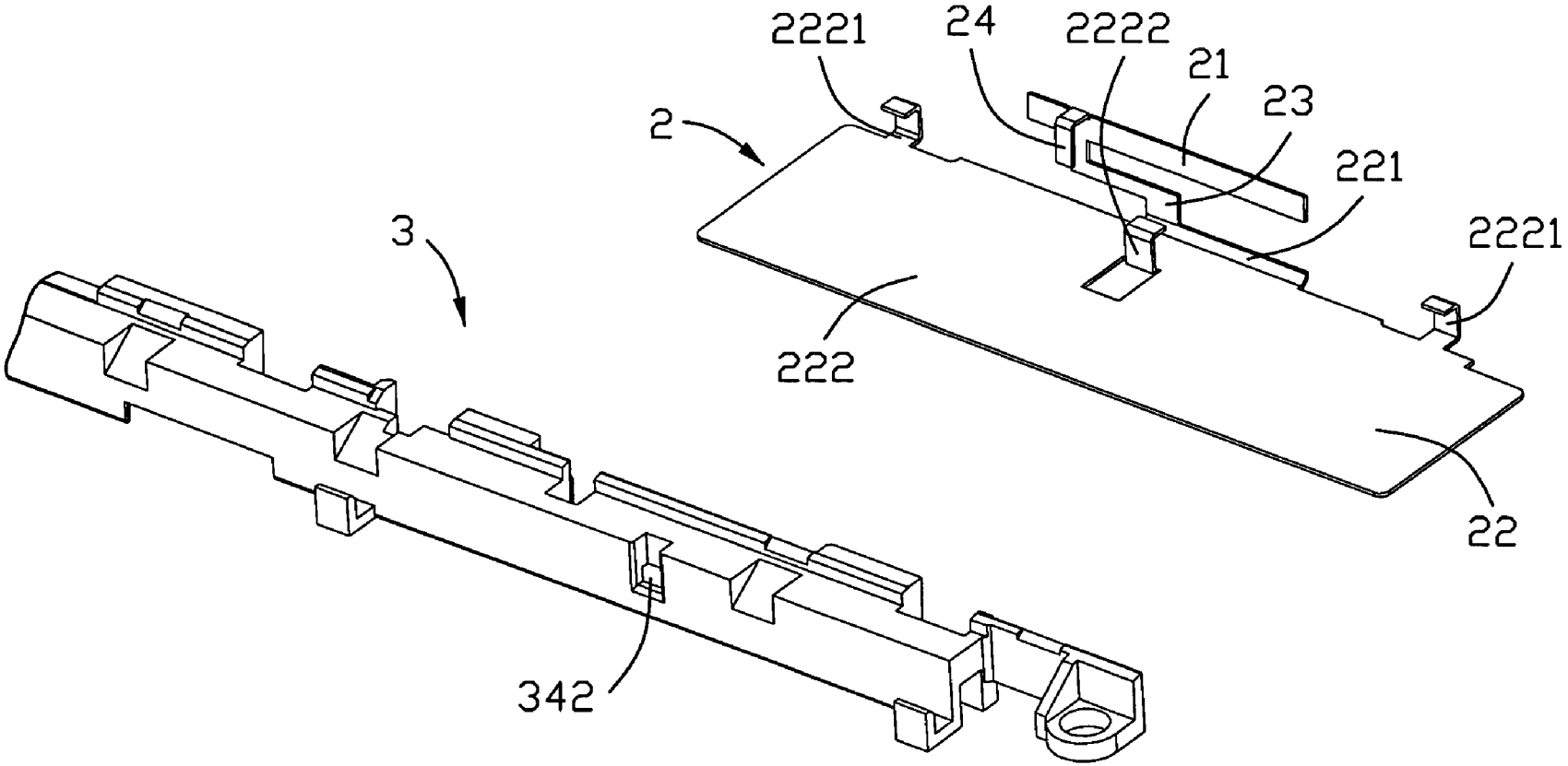
FIG. 3 is an exploded, perspective view of the antenna assembly.
Figure 4:
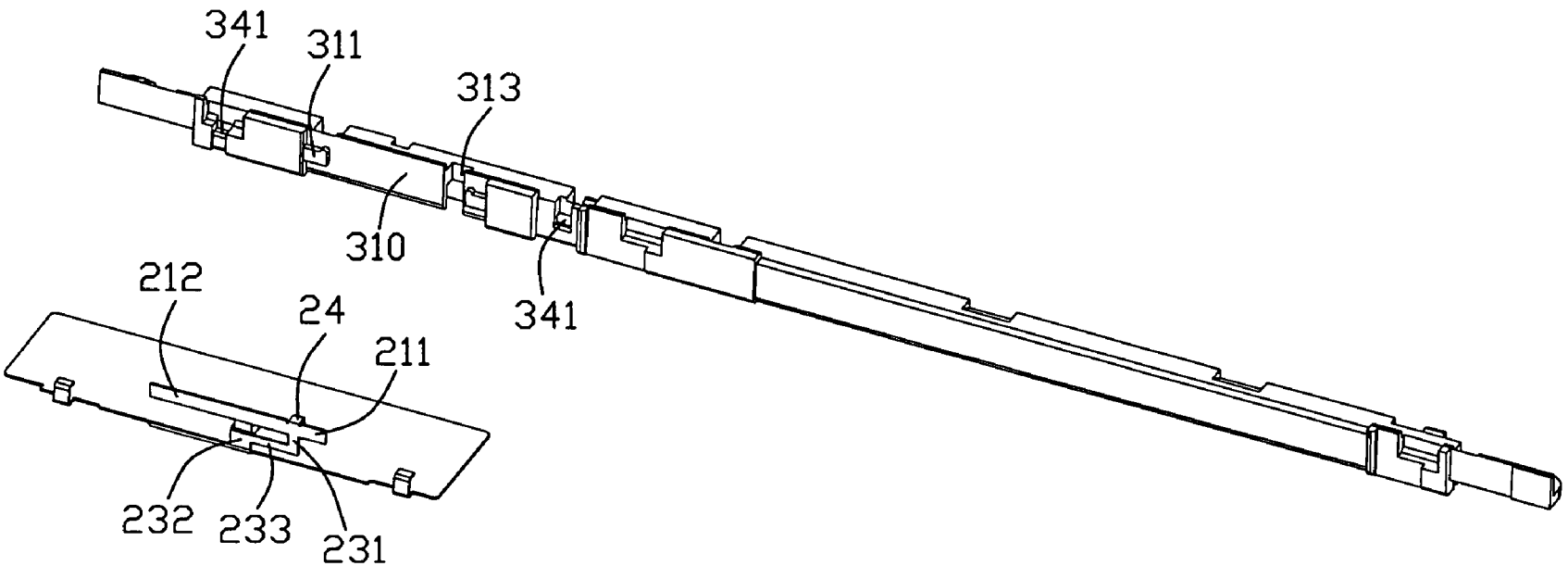
FIG. 4 is a view similar to FIG. 3, but viewed from another aspect.
Figure 5:
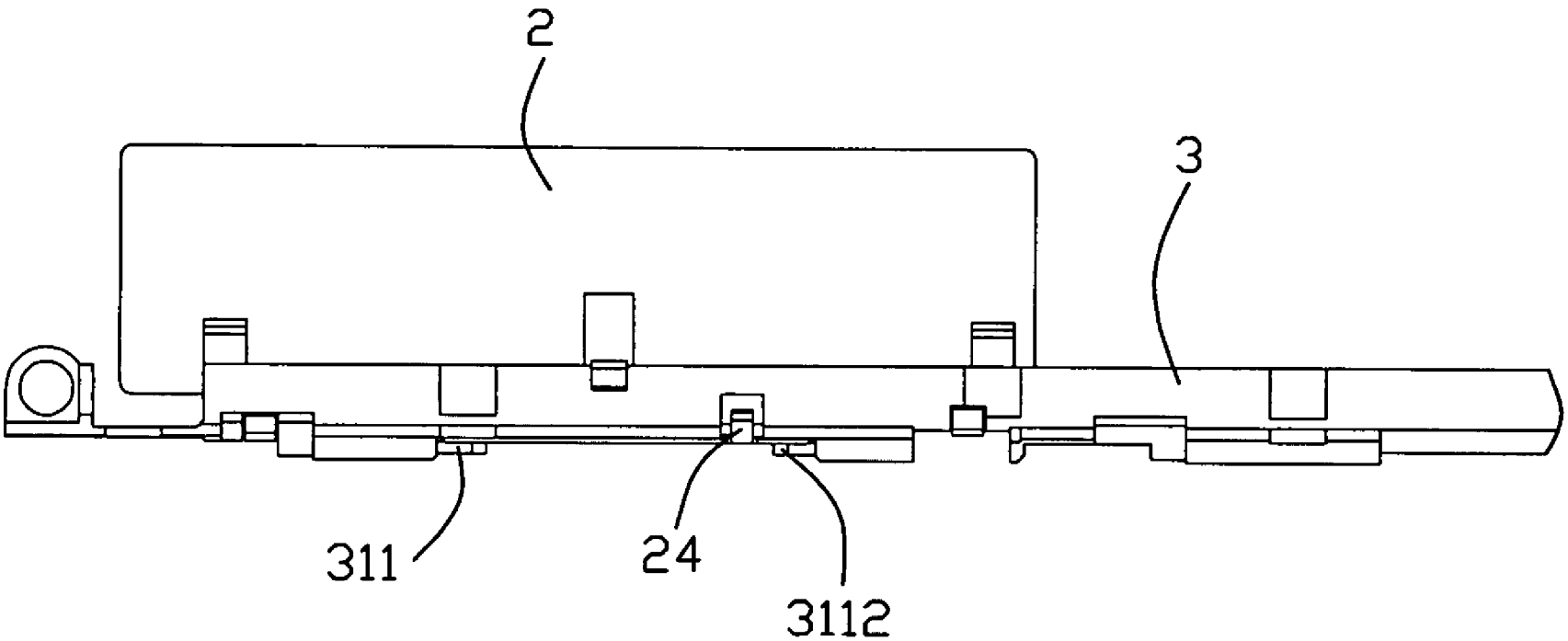
FIG. 5 is a top view of the antenna assembly.
Figure 6:
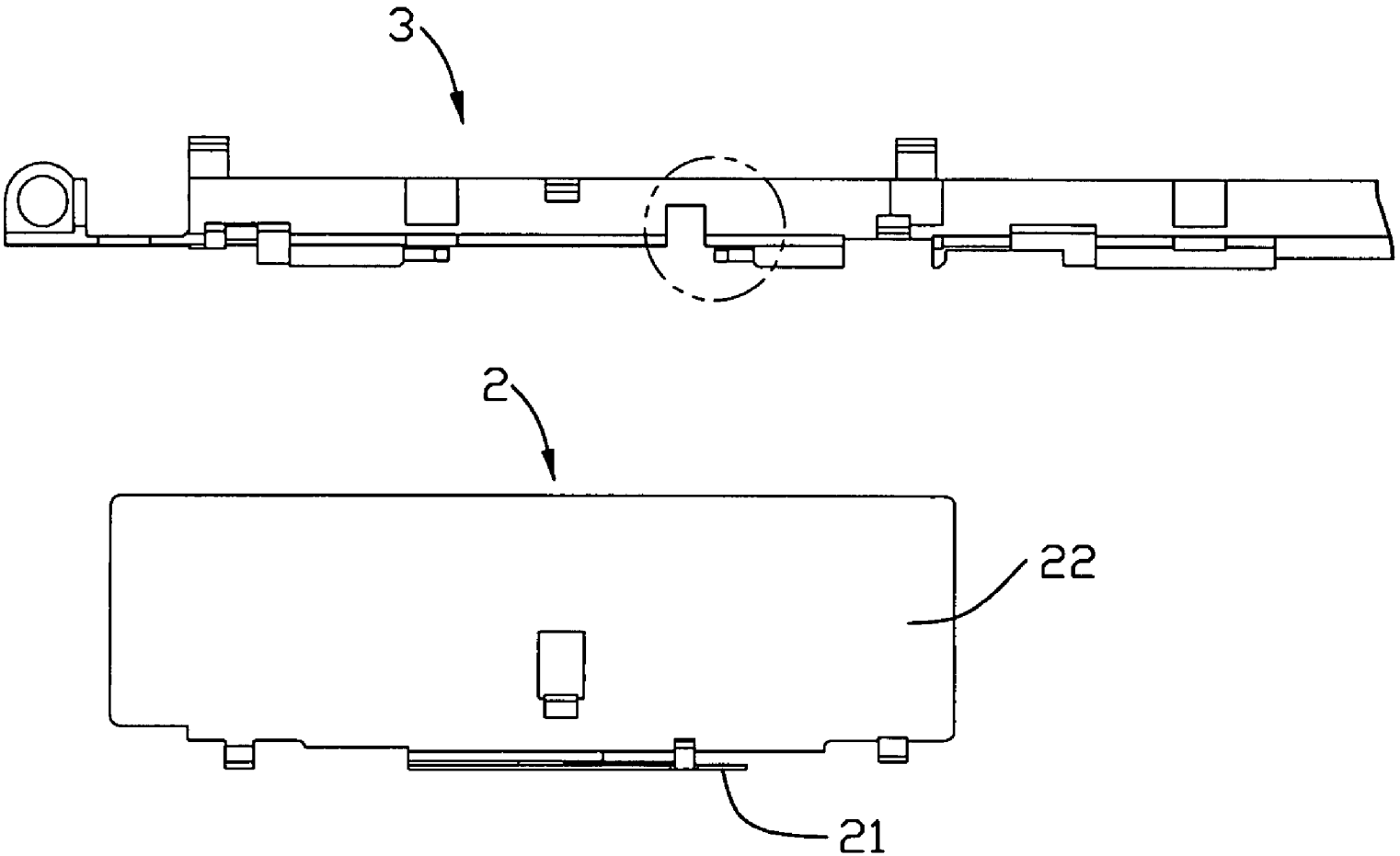
FIG. 6 is an exploded, top view of the antenna assembly.
Figure 7:
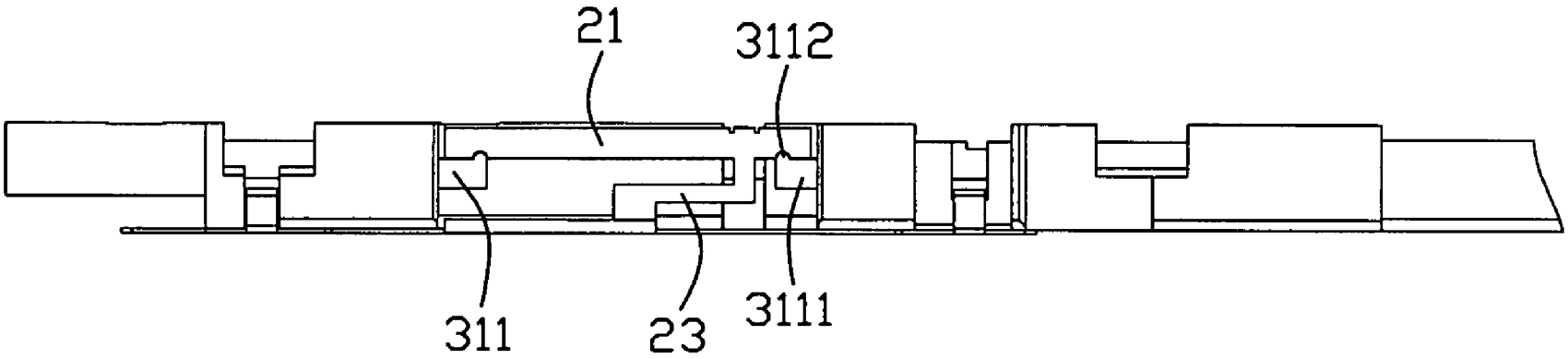
FIG. 7 is a side view of the antenna assembly.
Figure 8:
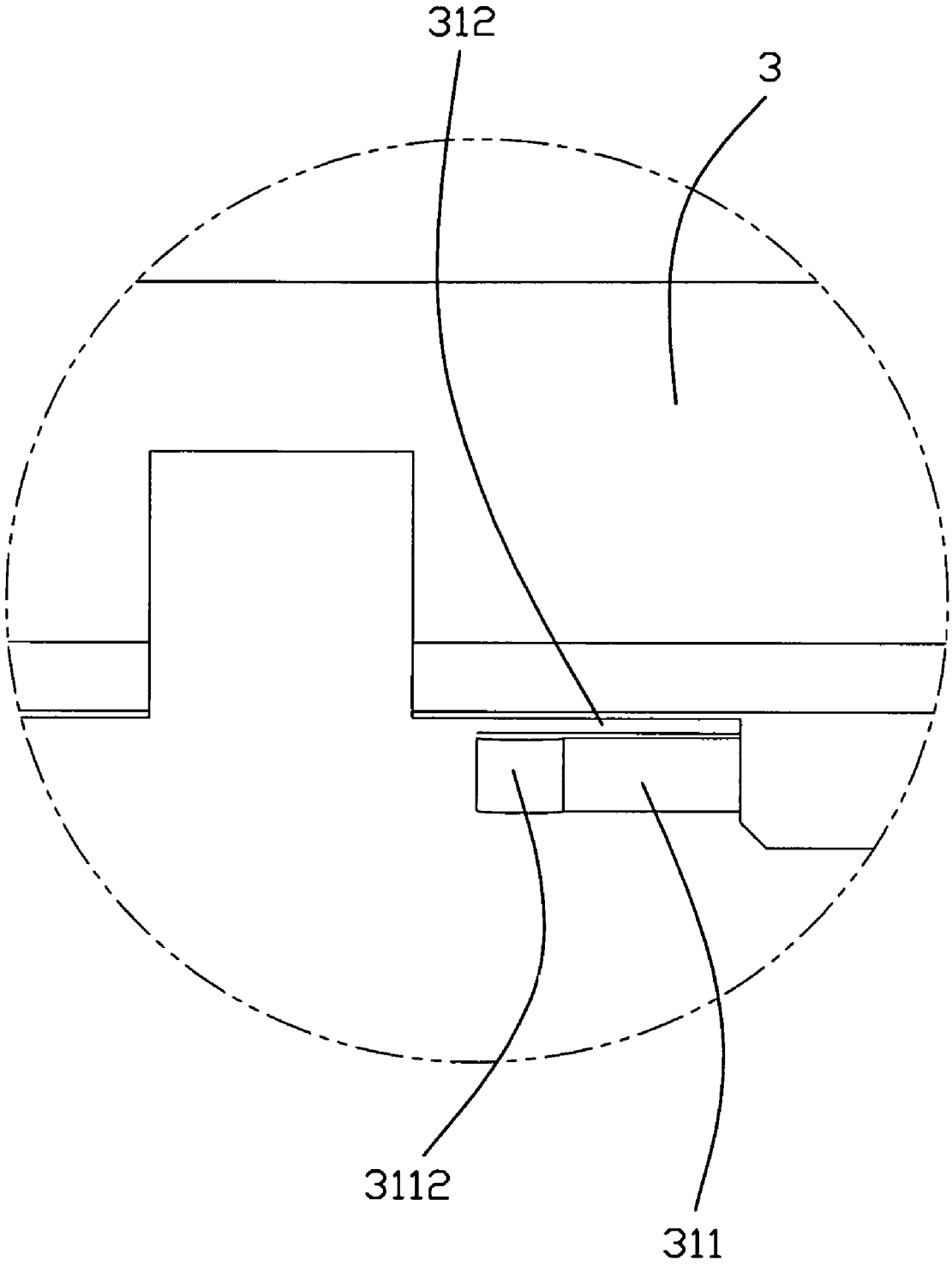
FIG. 8 is an enlarged view of the antenna assembly shown in FIG. 6.

Please referring to FIGS. 1-8, an antenna assembly according to the present invention is assembled in an electronic device, such as a notebook computer. The antenna assembly comprises a base 3 made of insulative material and an antenna 2 mounted on the base 3.

The antenna 2 is a planar inverted-F antenna, and comprises a longitudinal radiating element 21, a grounding element 22 perpendicular to the radiating element 21 and a connection strip 23. The radiating element 21 comprises a horizontal first radiating strip 211 and a horizontal second radiating strip 212 extending from the first radiating strip 2. The connection strip 23 interconnects the first and the second radiating strips 211, 212 with the grounding element 22, and comprises an upright first segment 231, a middle second segment 233 and an upright third segment 232. The first segment 231 extends downwardly from a joint of the first and the second radiating strips 211, 212. The second segment 233 horizontally extends from a lower end of the first segment 231. The third segment 232 extends downwardly from the second segment 233. The grounding element 22 is rectangular and connects with a lower end of the third segment 232. The grounding element 22 comprises a first grounding strip 221 located in a same plane with the radiating element 21 and a second grounding strip 222 perpendicular to the first grounding strip 221. A pair of first engaging fingers 2221 and a second engaging finger 2222 are formed integrally with the second grounding strip 222 to hold the antenna 2 on the base 3.

The antenna assembly further comprises a coaxial cable (not shown). The coaxial cable has an inner core conductor and an outer shield conductor surrounding and insulated from the inner core conductor. The inner core conductor is soldered to an L-shaped soldering arm 24 which connects with the radiating element 21. The outer shield conductor is soldered on the grounding element 22 for grounding the antenna 2.

Please referring to FIGS. 1-4, the base 3 comprises a depressed area 31 adapted for receiving the antenna 2, positioning mechanisms 32 and screw holes 33 adapted for fixing the base 3 on a notebook. The depressed area 31 defines a pair of sidewalls (not labeled) and a bottom surface 310 between the pair of sidewalls.

The radiating element 21 and the connection strip 23 are mounted on the bottom surface 310 of the depressed area 31. A pair of extending arms 311 extends along the radiating element 21 from the pair of sidewalls, and a space 312 which is used for receiving the antenna 2 is formed between the extending arm 311 and the bottom surface 310.

Each extending arm 311 comprises a base 3111 extending inwards from the sidewall of the depressed area 31 and a semicircular protrusion 3112 extending forwards from the base 3111. The semicircular protrusion 3112 locates right above the radiating element 21 to prevent the radiating element 21 from tilting upwards in excess. Moreover, the base 3111 of extending arm 311 don't cover the radiating element 21 at all. Thus, most of the radiating element 21 is exposed outside and the antenna 2 has a good Radiation Effect.

The depressed area 31 opens forwards and backwards, so it is easy for the antenna 2 to extend forwards into the space 312 of the depressed area 31. Some apertures 341, 342 are formed in the base 3 for interferential receiving the engaging fingers 2221, 2222. A receiving space 313 is depressed from the bottom surface 310 of the base 3 to receive the soldering arm 24 of the antenna 2.

Before the antenna 2 is mounted onto the base 3, a Double Faced Adhesive Tape (not shown) is pasted on the bottom surface 310. Therefore, finally the Double Faced Adhesive Tape will fix the antenna 2 and the base 3 together.

Even Double Faced Adhesive Tape fails in exceptional circumstances, the tilting upwards deformation of the radiating element 21 will be still limited by the semicircular protrusions 3112. So the distant of the antenna 2 from the base 3 is stable, and the antenna 2 has a stable Dielectric Constant and stable Voltage Standing Wave Ratio (VSWR).

While the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

What is claimed is:

1. An antenna assembly, comprising:
a base having a mounting surface;
an antenna comprising a radiating element with top and bottom surfaces thereof, said bottom surface of the radiating element abutting against and surface mounted on the mounting surface of said base; and
an arm extending from the base and spaced apart the mounting surface, and the arm located above said top surface of the radiating element so as to prevent the radiating element from tilting upwards excessively, most of the radiating element exposed outside the arm.

2. The antenna assembly as claimed in claim 1, wherein said arm is formed integrally with the base and paralleled with the mounting surface of said arm.

3. The antenna assembly as claimed in claim 1, wherein said arm comprises a body extending along but not covering the radiating element and a protrusion extending to the radiating element from the body of the arm, and the protrusion is located right above the radiating element so as to prevent the radiating element from tilting upwards excessively.

4. The antenna assembly as claimed in claim 3, wherein said arm is formed integrally with the base.

5. The antenna assembly as claimed in claim 1, wherein said radiating element is slender and elongated, and the antenna assembly comprises at least a pair of said arms located above opposite sides of the radiating element.

6. The antenna assembly as claimed in claim 1, wherein a soldering arm with thereof a feeder adapted for being soldered to a cable connects with said radiating element and separates said radiating element into a long radiating strip and a short radiating strip, and said arm is located above said long radiating strip.

7. The antenna assembly as claimed in claim 1, wherein some engaging fingers are formed integrally with the antenna to hold the antenna on the base.

8. The antenna assembly as claimed in claim 1, wherein said bottom surface of the radiating element is pasted onto said base.

9. The antenna assembly as recited in claim 1, wherein said base further defines a depressed area formed on the mounting surface thereof, and the radiating element is received into the depressed area.

10. An antenna assembly, comprising:
a base comprising a depressed area, the depressed area defining a pair of sidewalls opposite to each other and a mounting surface between the pair of sidewalls, an arm formed integrally with the sidewalls of the depressed area and spaced from the mounted surface so that a space is defined between the arm and the mounting surface;
an antenna comprising a radiating element with top and bottom surfaces thereof, said radiating element inserted into said space and said bottom surface of the radiating element abutting against and surface mounted on said mounting surface of the depressed area; and
wherein, said arm is configured to prevent the radiating element from tilting upwards excessively and make most of the radiating element exposed outside the arm.

11. The antenna assembly as claimed in claim 10, wherein said arm comprises a body extending along but not covering the radiating element and a protrusion extending to the radiating element from the body of the arm, and the protrusion is located right above the radiating element so as to prevent the radiating element from tilting upwards excessively.

12. The antenna assembly as claimed in claim 10, wherein said radiating element is slender and elongated, and the antenna assembly comprises at least a pair of said arms located above opposite sides of the radiating element.

13. The antenna assembly as claimed in claim 10, wherein a soldering arm with thereof a feeder adapted for being soldered to a cable connects with said radiating element and separates said radiating element into a long radiating strip and a short radiating strip, and said arm is located above said long radiating strip.

14. The antenna assembly as claimed in claim 10, wherein some engaging fingers are formed integrally with the antenna to hold the antenna on the base.

15. The antenna assembly as claimed in claim 10, wherein said bottom surface of the radiating element is pasted onto said mounted surface of the base.

16. An antenna assembly comprising:
an insulative base extending along a lengthwise direction;
a depressed area formed in an elongated face of the base;
an antenna comprising a grounding element and a radiating element essentially respectively lying in first and second planes perpendicular to each other, said radiating element essentially received in the depressed area; wherein
the base unitarily forms an arm pressing upon an edge portion of an exterior face of the radiating element so as to cooperate with the face to sandwich the radiating element therebetween for preventing tilting of the radiating element while allowing most portions of the radiating element exposed to an exterior.

17. The antenna assembly as claimed in claim 16, wherein said base further defines a receiving space to receive a solder arm unitarily extending from the radiating element.

18. The antenna assembly as claimed in claim 16, wherein said base further defines a plurality of apertures to receive corresponding fingers unitarily extending from the grounding element.

* * * * *